US009822587B2

(12) United States Patent
Prill et al.

(10) Patent No.: US 9,822,587 B2
(45) **Date of Patent: *Nov. 21, 2017**

(54) METHOD AND APPARATUS FOR CONTROLLING DOWNHOLE ROTATIONAL RATE OF A DRILLING TOOL

(71) Applicant: DRECO ENERGY SERVICES ULC, Edmonton (CA)

(72) Inventors: Jonathan Ryan Prill, Edmonton (CA); Nicholas Ryan Marchand, Edmonton (CA); Ralph William Graeme Johns, Edmonton (CA)

(73) Assignee: Dreco Energy Services ULC, Alberta (CA)

( * ) Notice: Subject to any disclaimer, the term of this patent is extended or adjusted under 35 U.S.C. 154(b) by 0 days.

This patent is subject to a terminal disclaimer.

(21) Appl. No.: 14/961,544

(22) Filed: Dec. 7, 2015

(65) Prior Publication Data

US 2016/0084004 A1 Mar. 24, 2016

Related U.S. Application Data

(63) Continuation of application No. 12/988,274, filed as application No. PCT/US2009/040983 on Apr. 17, 2009, now Pat. No. 9,206,647.

(30) Foreign Application Priority Data

Apr. 18, 2008 (CA) ..... 2629535

(51) Int. Cl.
*E21B 4/02* (2006.01)
*E21B 21/08* (2006.01)
(Continued)

(52) U.S. Cl.
CPC ..... *E21B 4/02* (2013.01); *E21B 3/00* (2013.01); *E21B 7/06* (2013.01); *E21B 21/08* (2013.01); *E21B 21/10* (2013.01); *E21B 44/005* (2013.01)

(58) Field of Classification Search
CPC ..... E21B 4/02; E21B 21/08
See application file for complete search history.

(56) References Cited

U.S. PATENT DOCUMENTS 6,347,674 B1 * 2/2002 Bloom ..... E21B 4/18 175/104
7,757,781 B2 * 7/2010 Hay ..... E21B 4/02 175/107

(Continued)

*Primary Examiner* — Giovanna C Wright
(74) *Attorney, Agent, or Firm* — Conley Rose, P.C.

(57) ABSTRACT

A downhole rotational rate control apparatus, adapted for coupling to the lower end of a drill string, includes a progressive cavity pump or motor, a mud flow control valve, and an electronics section. Drilling mud flowing downward through the drill string is partially diverted to flow through the pump or motor, with the mud flow rate and, in turn, the pump or motor speed being controlled by the mud flow control valve. The control valve is actuated by a control motor in response to inputs from a sensor assembly in the electronics section. By varying the rotational rate of the pump or motor relative to the rotational rate of the drill string, the tool face orientation or non-zero rotational speed of the controlled device in either direction can be varied in a controlled manner.

11 Claims, 4 Drawing Sheets

(51) Int. Cl.

| | |
|---|---|
| ***E21B 21/10*** | (2006.01) |
| ***E21B 44/00*** | (2006.01) |
| ***E21B 7/06*** | (2006.01) |
| ***E21B 3/00*** | (2006.01) |

(56) References Cited

U.S. PATENT DOCUMENTS

| | | | | |
|---|---|---|---|---|
| 9,206,647 | B2 * | 12/2015 | Prill | E21B 7/06 |
| 2006/0243493 | A1 * | 11/2006 | El-Rayes | E21B 4/02 175/107 |
| 2008/0164062 | A1 * | 7/2008 | Brackin | E21B 44/005 175/24 |

* cited by examiner

METHOD AND APPARATUS FOR CONTROLLING DOWNHOLE ROTATIONAL RATE OF A DRILLING TOOL

CROSS-REFERENCE TO RELATED APPLICATIONS

This application is a continuation of U.S. patent application Ser. No. 12,988,274, filed Oct. 15, 2010, which is the National Stage of International Patent Application No. PCT/US2009/040983, filed Apr. 17, 2009, which claims the benefit of Canadian Patent Application Serial No. 2,629,535 filed Apr. 18, 2008, entitled "Downhole Rotational Rate Control System."

STATEMENT REGARDING FEDERALLY SPONSORED RESEARCH OR DEVELOPMENT

Not applicable.

FIELD OF THE INVENTION

The present invention relates generally to well-drilling methods and apparatus, and more particularly relates to methods and apparatus for controlling and adjusting the path of a wellbore.

BACKGROUND

In drilling a borehole (or wellbore) into the earth, such as for the recovery of hydrocarbons or minerals from a subsurface formation, it is conventional practice to connect a drill bit onto the lower end of a "drill string", then rotate the drill string so that the drill bit progresses downward into the earth to create the desired borehole. A typical drill string is made up from an assembly of drill pipe sections connected end-to-end, plus a "bottomhole assembly" ("BHA") disposed between the bottom of the drill pipe sections and the drill bit. The BHA is typically made up of sub-components such as drill collars, stabilizers, reamers and/or other drilling tools and accessories, selected to suit the particular requirements of the well being drilled.

In conventional vertical borehole drilling operations, the drill string and bit are rotated by means of either a "rotary table" or a "top drive" associated with a drilling rig erected at the ground surface over the borehole (or in offshore drilling operations, on a seabed-supported drilling platform or suitably-adapted floating vessel). During the drilling process, a drilling fluid (commonly referred to as "drilling mud" or simply "mud") is pumped under pressure downward from the surface through the drill string, out the drill bit into the wellbore, and then upward back to the surface through the annular space ("wellbore annulus") between the drill string and the wellbore. The drilling fluid carries borehole cuttings to the surface, cools the drill bit, and forms a protective cake on the borehole wall (to stabilize and seal the borehole wall), as well as other beneficial functions.

As an alternative to rotation by a rotary table or a top drive, a drill bit can also be rotated using a "downhole motor" (alternatively referred to as a "drilling motor" or "mud motor") incorporated into the drill string immediately above the drill bit. The technique of drilling by rotating the drill bit with a mud motor without rotating the drill string is commonly referred to as "slide" drilling. It is common in certain types of well-drilling operations to use both slide drilling and drill string rotation, at different stages of the operation.

One of the primary components of a downhole motor is the power section, which is commonly provided in the form of a progressive cavity motor (or "PC motor") comprising an elongate and generally cylindrical stator plus an elongate rotor which is eccentrically rotatable within the stator. As is well known in the art, a PC motor is essentially the same thing as a positive displacement pump (or "Moineau pump"), but operated in reverse, and therefore could also be referred to as a positive displacement motor. Although all of these terms thus may be used interchangeably, for simplicity and consistency the term "PC motor" will used throughout this patent document.

The rotor of the PC motor is formed with one or more helical vanes or lobes encircling a central shaft and extending along its length. The stator defines helical lobes of a configuration generally complementary to the rotor lobes, but numbering one more than the number of rotor lobes. In the typical operation of a downhole motor, drilling fluid flowing downward through the drill pipe assembly is diverted through the PC motor, causing the rotor to rotate within the stator, thus rotating a drive shaft and resulting in rotation of the drill bit (which is operably connected to the drive shaft through other components of the downhole motor and BHA).

A vertical wellbore (i.e., a wellbore that is intended to be vertical) can deviate the desired vertical path during the drilling process by reason of the drill bit deflecting when encountering subsurface obstacles such as faults or discontinuities in the formation through which the well is being drilled. Such deviations must be corrected in order for the wellbore to achieve the desired end point, and it is known to correct a deviated wellbore path using an orientable steerable downhole motor in conjunction with directional drilling techniques. However, the wellbore may deviate from the desired corrective path when using a steerable downhole motor due to difficulty with controlling the orientation of the drill string and the necessity of using slide drilling techniques with this drill string configuration. Accordingly, there is a need for simpler, more reliable, and less expensive systems and associated control mechanisms for driving and steering rotating downhole tools to return a deviated vertical wellbore to a vertical path.

A directional wellbore (i.e., a wellbore or a portion of a wellbore that is intended to have a non-vertical path) requires steering during the drilling process to have the resulting wellbore reach the predetermined target. Known directional drilling techniques using an orientable, steerable downhole motor are commonly used to direct the wellbore along a desired three-dimensional path, and to correct wellbore path deviations caused by subsurface obstacles and irregularities. However, as in the previously-discussed case of deviated vertical wellbores, the use of an orientable, steerable downhole motor to correct deviated directional wellbores can be complicated or frustrated by difficulties controlling the orientation of the drill string and the necessity of using slide drilling techniques with this drill string configuration. Accordingly, there is a further need for simpler, more reliable, and less expensive systems and associated control mechanisms for driving and steering rotating downhole tools to return a deviated directional wellbore to the intended path.

SUMMARY

Provided in accordance with a first aspect of the present invention is a rotational rate control apparatus provided for use in association with a controlled device (such as, but not limited to, a deviation control assembly or, simply, "deviation assembly") incorporated into the BHA of a drill string. Provided in accordance with a second aspect of the invention is a method for controlling the path of a wellbore, and for correcting deviations from a desired wellbore path, during the drilling of the wellbore.

In an embodiment, the rotational rate control apparatus of the invention comprises the following components in linear arrangement (beginning with the lowermost component):

- a progressive cavity (PC) motor;
- a driveshaft;
- a mud flow control valve;
- a control motor for operating the mud flow control valve; and
- a motor control assembly (alternatively referred to as the electronics section) for controlling the control motor.

Electric power for the apparatus is preferably provided by a battery pack disposed above the electronics section within the BHA. However, electrical power may alternatively be provided by other known means such as but not limited to a power generation turbine incorporated into the BHA. The upper end of the rotational rate control apparatus as described above is connectable, using well-known methods, to the lower end of the drill pipe (or, more typically, to additional BHA sub-components which in turn connect to the drill pipe). The lower end of the rotational rate control apparatus is operably connectable to a controlled device which terminates with a drilling tool such as a drilling bit. The controlled device does not form part of the broadest embodiments of the present invention. In embodiments in which the controlled device comprises a deviation assembly, the deviation assembly may be of any suitable type known in the art ("point-the-bit" and "push-the-bit" systems and a steerable downhole motor being three non-limiting examples thereof).

One or more inlet ports in the lower end of the PC motor housing allow a portion of the drilling mud being pumped downward through the drill string to enter the lower end of the PC motor and to move upward therein, thus causing the PC motor to rotate in the direction opposite to its normal rotational direction (e.g., when being used to rotate a drill bit). In order for such upward mud flow to occur, it is necessary to provide one or more exit ports at the upper end of the PC motor, whereby drilling mud exiting the upper end of the PC motor can flow into the well bore annulus. Mud flow through the exit ports is regulated by the mud flow control valve, which is actuated by a control motor in response to control inputs from a sensor assembly incorporated into the electronics section. The control motor preferably but not necessarily will be an electric motor. The sensor assembly may comprise one or more accelerometers, inclination sensors, pressure sensors, azimuth sensors, and/or rotational-rate sensors.

The electronics section senses the relative rotational rate of the rotational rate control system and operates the control motor to actuate the mud flow control valve assembly as required to control and regulate the upward flow of drilling mud through the PC motor, as required to effect desired changes in the rate of rotation of the deviation assembly, in response to information from the sensor assembly. The PC motor drives the driveshaft and the deviation assembly (or other controlled device) at a specific zero or non-zero rotational rate. Using the mud flow control valve assembly and electronic control section, the speed of the PC motor is varied by controlled metering of the flow of drilling fluid that is directed through the PC motor.

In a first embodiment of the apparatus of the invention, a normally clockwise-rotating PC motor (as viewed from above) imparts a counterclockwise rotation to the deviation assembly by flowing drilling mud upward through the PC motor. An alternative second embodiment would have a normally counterclockwise-rotating PC motor delivering counterclockwise rotation to the deviation assembly by flowing drilling mud downward through the PC motor. In this embodiment, the mud inlet ports would be in an upper region of the PC motor and the mud exit ports and mud flow control valve would be at the lower end of the PC motor. A further alternative embodiment would have a PC motor configured such that clockwise rotational output is delivered to the controlled device or deviation assembly.

In accordance with the first embodiment described above, the rotor of the PC motor drives a coupling mandrel via a drive shaft, and the coupling mandrel is coupled to the controlled device (e.g., deviation assembly). By varying the relationship of the rotary speed of the PC motor compared to the rotational speed of the drill string, the tool face orientation (i.e., orientation of a drilling tool coupled to the controlled device) or non-zero rotational speed (in either direction) of the controlled device can be varied in a controlled manner. An electronically-controlled mud flow control valve assembly is used to meter the flow of drilling fluid through the PC motor, which controls the rotor's speed. In preferred embodiments, the mud flow control valve assembly comprises complementary tapered sliding sleeves which can be positioned with respect to one another to meter the flow of drilling fluid through the PC motor and into the wellbore annulus. The electronic control section and control motor are used to control the flow rate of drilling fluid through the valve assembly and to sense the orientation and direction of the tool (e.g., drilling bit), thus facilitating the return of a deviated wellbore to vertical, or the return of a directional wellbore to an intended path.

BRIEF DESCRIPTION OF THE DRAWINGS

Embodiments of the invention will now be described with reference to the accompanying figures, in which numerical references denote like parts, and in which.

DETAILED DESCRIPTION OF THE PREFERRED EMBODIMENTS

Figure 1:
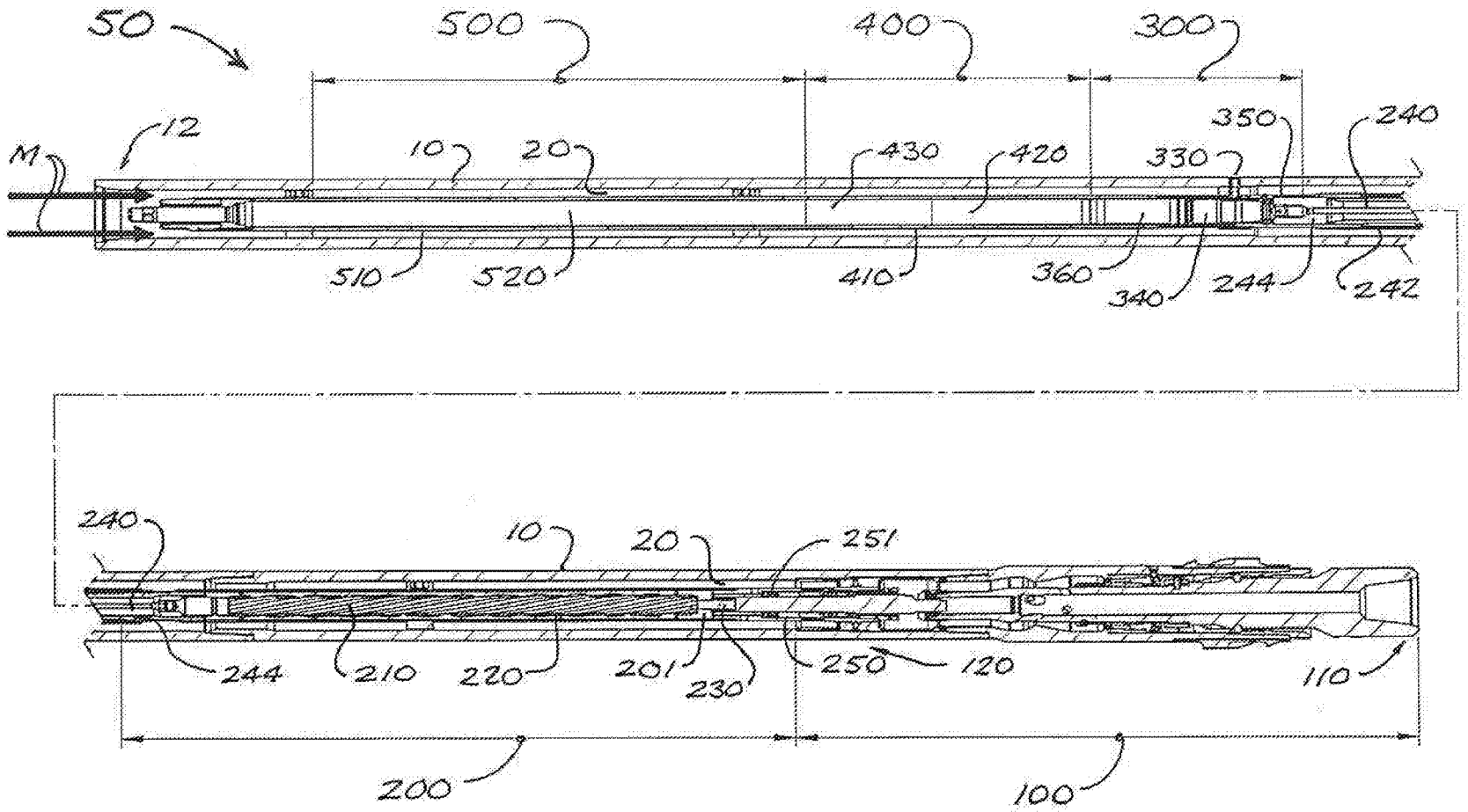
FIG. 1 is a longitudinal cross-section through a bottomhole assembly incorporating a rotational rate control apparatus in accordance with a first embodiment of the present invention.

The Figures illustrate a rotational rate control system 50 in accordance with an embodiment of the present invention, installed within a conventional cylindrical tool housing 10 in conjunction with a deviation assembly 100. Upper end 12 of tool housing 10 is adapted for connection to the lower end of a drill string (not shown), and is open to permit the flow of drilling mud from the drill string into tool housing 10 as conceptually indicated by arrows M in FIG. 1. Lower end 110 of deviation assembly 100 is adapted for connection to a drilling tool such as a drill bit (not shown).

As illustrated in FIG. 1, rotational rate control system 50 comprises a progressive cavity (PC) motor 200 of known type, an upper drive shaft 240 disposed within a drive shaft housing 242 having a drive shaft bore 244, a mud flow control valve assembly 300, and a motor control assembly (or electronics section) 400. In the illustrated embodiment, electrical power required for rotational rate control apparatus 50 is provided by a battery pack 500 attached to the upper end of electronics section 400. The disposition of rotational rate control system 50 within tool housing 10 creates a longitudinally continuous inner annulus 20 surrounding PC motor 200, drive shaft housing 242, mud flow control valve assembly 300, electronics section 400, and battery pack 500, such that drilling mud can be pumped downward through inner annulus 20.

In accordance with well-known technology, PC motor 200 has an elongate rotor 210 disposed within the central bore 201 of an elongate stator 220, with the upper end of rotor 210 being connected to upper drive shaft 240, and with the lower end of rotor 210 being connected to a lower drive shaft 230. Rotor 210 is radially eccentrically supported within stator 220, and stator 220 is radially and axially supported within tool housing 10. Rotor 210 is connected to upper end 120 of deviation assembly 100 via lower drive shaft 230, allowing deviation assembly 100 to be rotationally driven by rotor 210. In the illustrated embodiment, PC motor 200 is configured such that rotor 210 will rotate clockwise (as viewed from above) in response to a downward flow of drilling mud through central bore 201.

A lower ported motor housing 250 having one or more inlet ports 251 (sized and positioned to suit specific requirements) is attached to the lower end of stator 220 and allows lower drive shaft 230 to pass through for operative engagement with deviation assembly 100. By virtue of inlet ports 251, central bore 201 of stator 220 is in fluid communication with inner annulus 20 of tool housing 10 such that a flow of drilling mud through inner annulus 20 may be partially diverted into and upward within central bore 201, thereby rotating rotor 210 counterclockwise (as viewed from above).

Upper drive shaft 240 converts eccentric rotation of the rotor 210 within the PC motor 200 to concentric rotation of mud flow control valve assembly 300. Mud flow control valve assembly 300 includes a lower sleeve 310, an upper sleeve 320, at least one exit port sleeve 330 extending generally radially through the wall of tool housing 10, an inner valve housing 340, and an outer valve housing 350, with outer valve housing 350 being connected to or formed into the upper end of drive shaft housing 242. Upper sleeve 320 is sealingly attached to inner valve housing 340 while lower sleeve 310 is non-movingly secured to outer valve housing 350. Upper sleeve 320 is axially movable relative to lower sleeve 310, by means of a control motor 360 forming part of mud flow control valve assembly 300 and controlled by electronics section 400.

Figure 2:
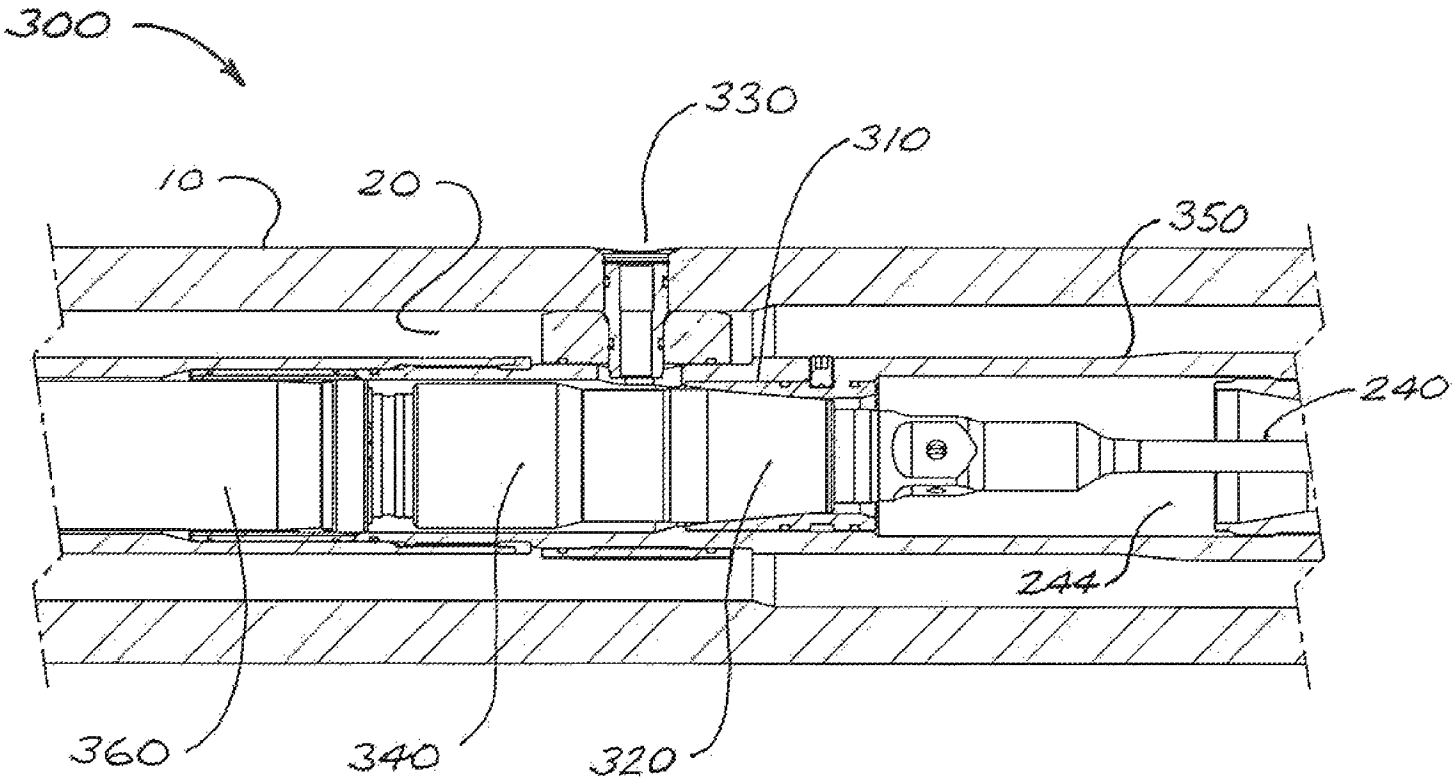
FIG. 2 is a cross-sectional detail of the mud flow control valve assembly of the rotational rate control apparatus of FIG. 1, with the mud flow control valve in the closed position.
Figure 3:
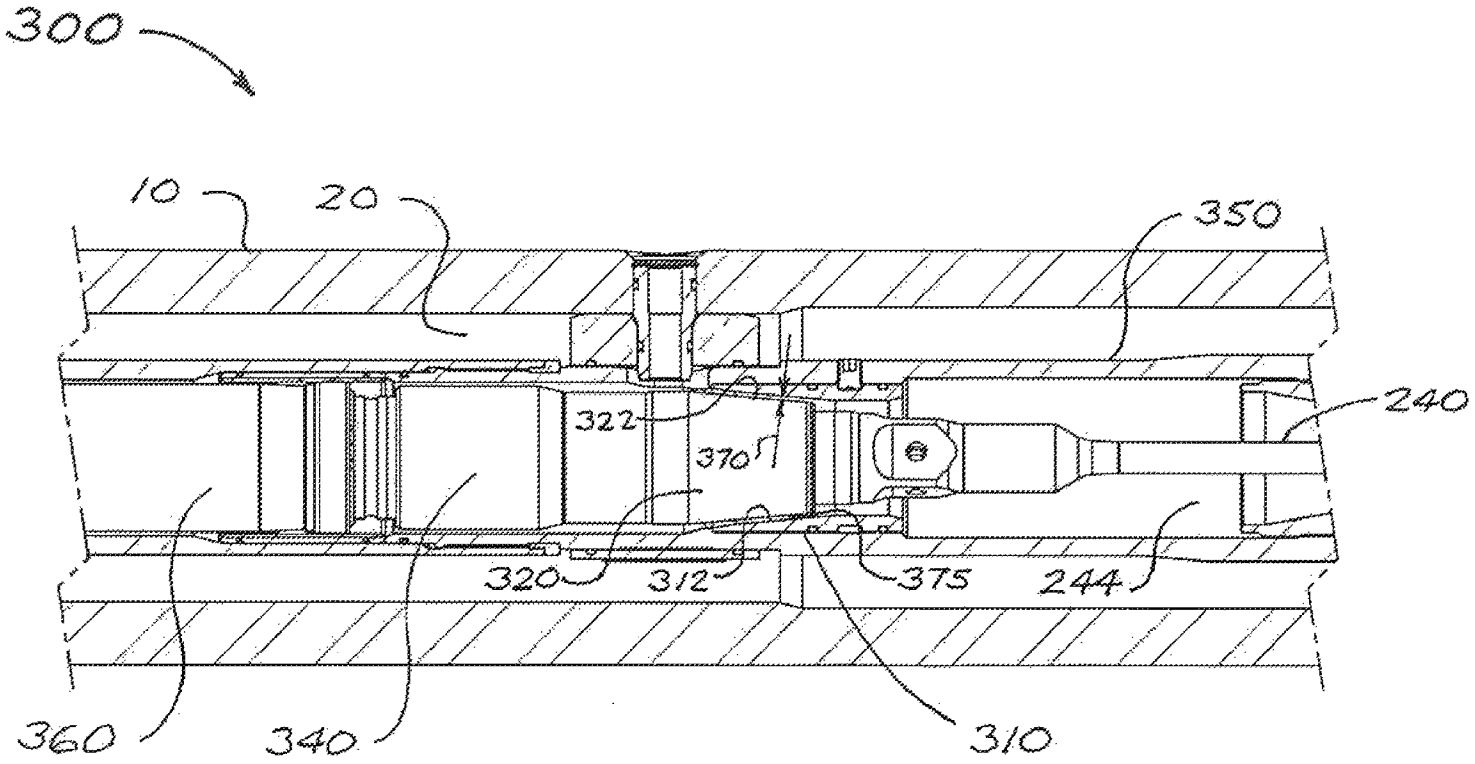
FIG. 3 is a cross-sectional detail of the mud flow control valve assembly of the rotational rate control apparatus of FIG. 1, with the mud flow control valve in an open position.

As best understood from FIGS. 2 and 3, lower sleeve 310 and upper sleeve 320 are of complementary configuration such that upper sleeve 320 is movable between a closed position in which at least a portion of the outer surface 322 of upper sleeve 320 is in sealing perimeter contact with at least a portion of the inner surface 312 of lower sleeve 310, and an open position which creates a gap 370 between inner surface 312 of lower sleeve 310 and outer surface 322 of upper sleeve 320, in turn creating a flow passage 375 through which drilling mud flowing upward within drive shaft bore 244 passes through flow passage 375 and exits through exit port sleeve 330. The flow rate of drilling mud through flow passage 375 will be governed by the breadth of gap 370, which is in turn governed by the position of upper sleeve 320 relative to lower sleeve 310. In preferred embodiments, the position of upper sleeve 320 relative to lower sleeve 310 can be adjusted incrementally, thus varying the breadth of gap 370 and the drilling mud flow rate. Accordingly, a reference herein to the valve assembly being in an open position is not to be understood or interpreted as referring to any specific setting or as being correlative to any specific position of upper sleeve 320 relative to lower sleeve 310.

In preferred embodiments, inner surface 312 of lower sleeve 310 and outer surface 322 of upper sleeve 320 are in the form of mating tapered surfaces (specifically, frustoconical surfaces in the illustrated embodiments). However, persons of ordinary skill in the art will readily appreciate that lower sleeve 310 and upper sleeve 320 could be provide in other geometric configurations (including, without limitation, non-cylindrical and non-tapered sleeves) without departing from the scope and basic functionality of the present invention.

In an embodiment particularly suited for drilling directional wellbores, electronics section 400 comprises a computational electronic control assembly 420 and a sensor assembly 430 disposed within an electronics housing 410. Computational electronic control assembly 420 includes a microprocessor and associated memory, for receiving and processing data obtained by sensor assembly 430, as will be described. Sensor assembly 430 comprises one or more inclination sensors and/or one or more azimuth sensors (suitable types of which devices are known in the art). Electronics section 400, with the information gathered by sensor assembly 430, operates control motor 360 to regulate or stop the flow of drilling fluid through PC motor 200 and thence through drive shaft bore 244 and flow passage 375, as may be required to produce desired changes in rotational rate of the deviation assembly 100 to maintain or correct the path of a directional wellbore.

An alternative embodiment particularly suited for drilling vertical wellbores is largely similar to the embodiment described above for drilling directional wellbores, with the exception that sensor assembly 430 may but will not necessarily comprise one or more inclination sensors and/or one or more azimuth sensors. The system otherwise functions in a substantially analogous fashion to produce desired changes in rotational rate of the deviation assembly 100 to maintain or return the wellbore path to vertical.

Figure 4:
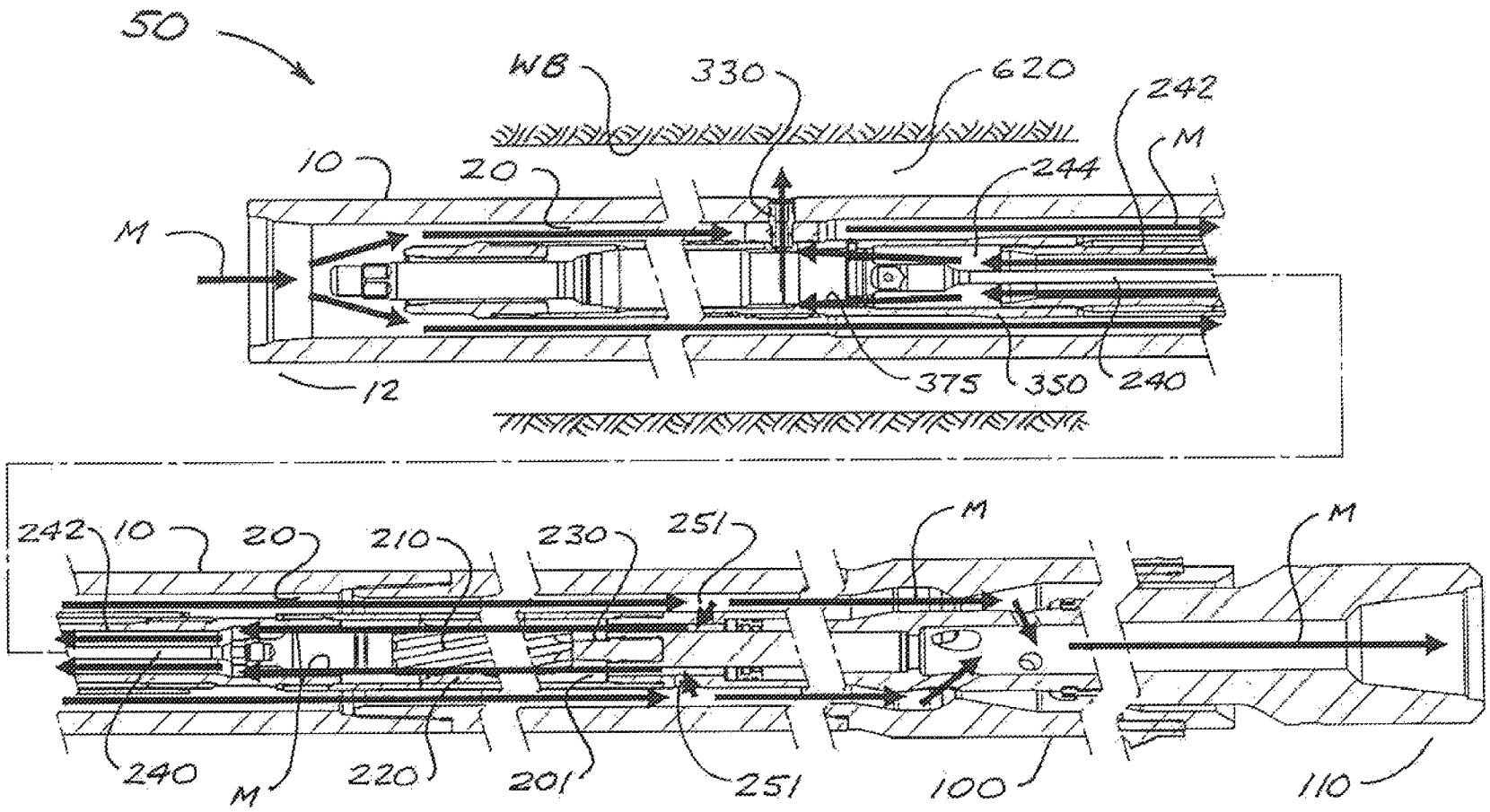
FIG. 4 is a longitudinal cross-section of the bottomhole assembly of FIG. 1, schematically illustrating flow paths of drilling fluid circulating through the assembly.

The practical operation of the apparatus of the present invention may be readily understood with reference to the foregoing descriptions and to the Figures (particularly FIG. 4, in which arrows M indicate drilling mud flows). During well-drilling operations, drilling mud is pumped from ground surface through the drill pipe assembly and flows downhole through inner annulus 20 of tool housing 10. As the drilling mud approaches PC motor 200 (and as may be particularly well understood with reference to FIG. 4), some of the drilling mud will be diverted into central bore 201 of stator 220 through inlet ports 251 in motor housing 250 (provided that flow passage 375 within mud flow control valve assembly 300 is open to permit mud to exit central bore 201), with the non-diverted portion of the drilling mud continuing downhole through inner annulus 20 toward and into deviation assembly 100. More specifically, a pressure drop created at or below deviation assembly 100 redirects the drilling mud flow and results in approximately between 1% and 10% of the drilling mud used by the tool being diverted into and upward through central bore 201 of PC motor 200. Drilling mud circulating upward through PC motor 200 carries on upward through drive shaft bore 244, passes through flow passage 375 of mud flow control valve assembly 300, and exits through exit port sleeve 330 into the wellbore annulus 620 between the tool casing 10 and the wellbore WB being drilled.

Rotor 210 of PC motor 200 is powered by the uphole-flowing drilling mud within central bore 201 that flows at a higher pressure than the drilling mud in wellbore annulus due to the pressure drops caused by the downhole restrictions such as bit nozzles, and mud flow control valve assembly 300. The effect of drilling mud flowing through PC motor 200 in an uphole direction is to create a counterclockwise rotation of rotor 210 (as viewed from above). In typical downhole motor applications, the rotation of the drill string for purposes of drilling is clockwise. Similarly, in drilling operations using apparatus in accordance with the present invention, tool housing 10 rotates with the drill string in a clockwise direction, which is opposite to the rotation of rotor 210. The counterclockwise rotation of rotor 210 is transferred to lower drive shaft 230 and deviation assembly 100, and results in a counterclockwise rotation supplied to the upper end of the deviation control device 100 relative to the drill string.

Mud flow control valve assembly 300 is located uphole from PC motor 200 so that drilling mud exiting PC motor 200 enters into mud flow control valve assembly 300. Mud flow control valve assembly 300 is actuated by control motor 360, in response to control inputs from electronics section 400, to control the flow rate of drilling mud through PC motor 200 as required to rotate rotor 210 at an operationally appropriate rate.

Electronics housing 410 rotates at the same speed as rotor 210 in PC motor 200 due to the connection of rotor 210 and electronics housing 410 via upper drive shaft 240 and mud flow control valve assembly 300. Because of the clockwise rotation of tool housing 10 and the counterclockwise rotatability of electronics housing 410, sensor assembly 430 can be kept close to geo-stationary so that it does not rotate at a significant speed or is kept at a non-zero controlled rotational rate relative to tool housing 10. The ability to maintain sensor assembly 430 close to geo-stationary or at a non-zero controlled rotational rate is controlled by the operation of mud flow control valve assembly 300. As tool housing 10 rotates with the rest of the drill string, upper sleeve 320 is adjusted in response to inputs from sensor assembly 430 to meter the flow of drilling mud upward through PC motor 200, thereby controlling the rotational rate of rotor 210 and electronics housing 410 with respect to tool housing 10 in order to keep sensor assembly 430 as close to geo-stationary as possible or rotating at a desired non-zero controlled rotational rate. The rotational rate of 430 is measured by sensors within electronics section 400, and the speed of rotation of electronics housing 410 is controlled with respect to tool housing 10 by controlling the rotational rate of rotor 210 until sensor assembly 430 is geo-stationary or rotating at a desired non-zero controlled rotational rate.

Sensor assembly 430 may comprise an inertial grade, three-axis accelerometer of a type commonly used in "measuring while drilling" (or "MWD") operations, and functions to determine the direction, angular orientation, and speed at which to control the deviation assembly 100. In alternative embodiments, sensor assembly 430 may comprise two or three single-axis accelerometers. Sensor assembly 430 may also comprise one or more of any one or more of the following: inertial-grade azimuth sensors, rotational-rate sensors, temperature sensors, pressure sensors, gamma radiation sensors, and other sensors which would be familiar to persons skilled in the art.

Sensor assembly 430, in cooperation with other components of electronics section 400, helps to control the orientation and/or the rotational speed of deviation assembly 100 by sensing and determining the position and rotational rate, relative to the earth, of sensor assembly 430, which is coupled to deviation assembly 100. When upper sleeve 320 of flow control valve assembly 300 is in an open position, thus allowing fluid flow through PC motor 200, electronics section 400, upper sleeve 320, inner valve 340, control motor 360, and rotor 210 of PC motor 200 all rotate counterclockwise relative to tool housing 10. Sensor assembly 430 takes readings to determine the rotational rate of sensor assembly 430 with respect to the immediate wellbore axis. The rotational rate sensed by sensor assembly 430 is conveyed to control motor 360, which correspondingly adjusts the axial position of upper sleeve 320 to change the speed of PC motor 200 as appropriate (e.g., such that the drilling tool is stationary and oriented in a desired direction, or such that the tool is rotating at a desired non-zero controlled rotational rate).

In one embodiment, the desired rotational rate is zero or geostationary, and accelerometers and/or magnetometers within sensor assembly 430 and electronics assembly 400 control the control motor 360 to orient sensor assembly 430 (which is coupled to deviation assembly 100) to a desired orientation with respect to the earth's gravitational field and/or the earth's magnetic field. Sensor assembly 430 periodically senses the orientation of the tool with respect to Earth to ensure that the tool is pointed in the desired direction and/or rotating at the desired rotational rate and to correct any deviations. When sensor assembly 430 senses that adjustment is needed, the rotational rate of rotor 210 of PC motor 200 is changed by moving upper sleeve 320, thus controlling the relative rotational speeds of rotor 210 of PC motor 200 and electronics housing 410 as appropriate to achieve a desired orientation of the tool. Once the tool is positioned as desired, the rotational rate of rotor 210 of PC motor 200 is controlled such that electronics section 400 and sensor assembly 430 remain geo-stationary.

While preferred embodiments have been shown and described herein, modifications thereof can be made by one skilled in the art without departing from the scope and teaching of the present invention, including modifications which may use equivalent structures or materials hereafter conceived or developed. The described and illustrated embodiments are exemplary only and are not limiting. It is to be especially understood that the substitution of a variant of a claimed element or feature, without any substantial resultant change in the working of the invention, will not constitute a departure from the scope of the invention. It is to also be fully appreciated that the different teachings of the embodiments described and discussed herein may be employed separately or in any suitable combination to produce desired results.

It should be noted in particular that the Figures depict a normally clockwise-rotating PC motor 200 configured within rotational rate control system 50 such that the rotational output to deviation assembly 100 is counterclockwise, with mud flow control valve assembly 300 positioned above drive shaft 240 and PC motor 200. However, persons skilled in the art will appreciate from the present teachings that the various components of rotational rate control system 50 can be readily adapted and arranged in alternative configurations to provide different operational characteristics (for example, downward mud flow through PC motor 200 to produce clockwise rotation of rotor 210) without departing from the principles and scope of the present invention.

Persons skilled in the art will also appreciate that alternative embodiments of the apparatus of the invention could incorporate known types of valves, adapted as appropriate, in lieu of a dual-sleeve mud flow valve assembly of the type illustrated in the Figures. To provide specific non-limiting examples, known types of ball valve, gate valve, globe valve, plug valve, needle valve, diaphragm valve, and/or butterfly valve could be adapted for use in lieu of a dual-sleeve valve assembly, without departing from the scope of the present invention.

In this patent document, the word "comprising" is used in its non-limiting sense to mean that items following that word are included, but items not specifically mentioned are not excluded. A reference to an element by the indefinite article "a" does not exclude the possibility that more than one of the element is present, unless the context clearly requires that there be one and only one such element. Any use of any form of the terms "connect", "engage", "couple", "attach", or any other term describing an interaction between elements is not meant to limit the interaction to direct interaction between the elements and may also include indirect interaction between the elements described.

What is claimed is:

1. A drilling apparatus for a wellbore comprising:

a housing;

a progressive cavity pump or motor disposed in the housing and rotationally connectable to a controlled device, the progressive cavity pump or motor comprising a stator supported by the housing and a rotor that rotates within the stator;

a flow control valve assembly to meter a flow of drilling fluid through the progressive cavity pump or motor;

a control motor to directly control the flow control valve assembly; and an electronics section that rotates relative to the housing by the rotor, the electronics section controls the control motor to vary the metered flow through the progressive cavity pump or motor and thereby orientate the controlled device in the wellbore.

2. The drilling apparatus of claim 1 wherein the progressive cavity motor is coupled to the flow control valve assembly by a drive shaft.

3. The drilling apparatus of claim 1 wherein the rotor is counter-rotatable within the stator to counter-rotate the electronics section relative to the housing.

4. The drilling apparatus of claim 1 wherein the electronics section comprises a sensor to sense wellbore data.

5. The drilling apparatus of claim 4 wherein the electronics section, based on the sensed wellbore data, controls the relative rotational speeds of the housing and the electronics section to orientate the controlled device in the wellbore.

6. A drilling apparatus for a wellbore comprising:

a housing;

a progressive cavity pump or motor disposed in the housing and rotationally connectable to a controlled device, the progressive cavity pump or motor comprising a stator supported by the housing and a rotor that counter-rotates within the stator;

a flow control valve assembly to meter a flow of drilling fluid through the progressive cavity pump or motor;

a control motor to directly control the flow control valve assembly; and an electronics section that counter-rotates relative to the housing by the rotor, the electronics section controls the control motor while in the wellbore to vary the metered flow through the progressive cavity pump or motor.

7. The drilling apparatus of claim 6 wherein the electronics section comprises a sensor to sense wellbore data.

8. The drilling apparatus of claim 7 wherein the electronics section, based on the sensed wellbore data, controls the control motor to vary the metered flow through the progressive cavity pump or motor and thereby control the relative rotational speeds of the housing and the counter-rotating electronics section.

9. The drilling apparatus of claim 7 wherein the electronics section, based on the sensed wellbore data, controls the control motor to vary the metered flow through the progressive cavity pump or motor and thereby keep the sensor geo-stationary or rotating at a controlled non-zero rotational rate relative to the housing.

10. The drilling apparatus of claim 7 wherein the electronics section, based on a rotational rate of the sensor, is adapted to control the control motor to change the flow through the flow control valve assembly and the progressive cavity pump or motor to orient the controlled device in a desired direction.

11. A drilling apparatus for a wellbore comprising:

a housing;

a progressive cavity pump or motor disposed in the housing and rotationally connectable to a controlled device, the progressive cavity pump or motor comprising a stator supported by the housing and a rotor that is counter-rotatable within the stator;

a flow control valve assembly to meter a flow of drilling fluid through the progressive cavity pump or motor;

a control motor to control the flow control valve assembly; and an electronics section counter-rotatable relative to the housing by the rotor, the electronics section adapted to control the control motor while in the wellbore to vary the metered flow through the progressive cavity pump or motor;

wherein the rotor is coupled to the controlled device by a drive shaft to counter-rotate the controlled device relative to the housing.

* * * * *